United States Patent [19]

Hardy et al.

[11] Patent Number: 4,557,323

[45] Date of Patent: Dec. 10, 1985

[54] HEAT EXCHANGER AND METHOD OF MAKING SAME

[75] Inventors: Brian E. Hardy, Burbank; Harold D. Sealey, Vermillion, both of S. Dak.

[73] Assignee: Electro-Magic, Inc., Vermillion, S. Dak.

[21] Appl. No.: 520,460

[22] Filed: Aug. 4, 1983

[51] Int. Cl.[4] ..... F28D 7/04; F22B 5/02; F22B 37/10

[52] U.S. Cl. ..... 165/163; 165/159; 122/18; 122/248

[58] Field of Search ..... 165/163, 159; 122/18, 122/19, 14, 248, 247, 245, 246

[56] References Cited

U.S. PATENT DOCUMENTS

| | | | |
|---|---|---|---|
| 972,717 | 10/1910 | Radke | 122/18 |
| 1,237,737 | 8/1917 | Albert | 122/18 |
| 1,382,670 | 6/1921 | Price | 165/163 |
| 1,702,241 | 2/1929 | Buckley | 122/245 |
| 1,991,557 | 2/1935 | Johnson | 122/14 |
| 4,191,168 | 3/1980 | Allen et al. | 165/163 |

FOREIGN PATENT DOCUMENTS

| | | | |
|---|---|---|---|
| 780596 | 3/1935 | France | 165/163 |

*Primary Examiner*—William R. Cline
*Assistant Examiner*—John K. Ford
*Attorney, Agent, or Firm*—Hill, Van Santen, Steadman & Simpson

[57] ABSTRACT

A heat exchanger is provided which has a heat exchanger coil made from a continuous length of tubing arranged in an alternating series of conical helical and reverse conical helical winds wherein the medium to be heated flows downwardly through the coil and the heated medium from which heat energy is to be transferred flows upwardly around the coil in counter flow fashion to provide for a compact and efficient heat exchanger. Two methods of constructing such a coil are disclosed which utilize one or more mandrels to form the tubing into the approximately shaped coil.

5 Claims, 8 Drawing Figures

FIG. 1
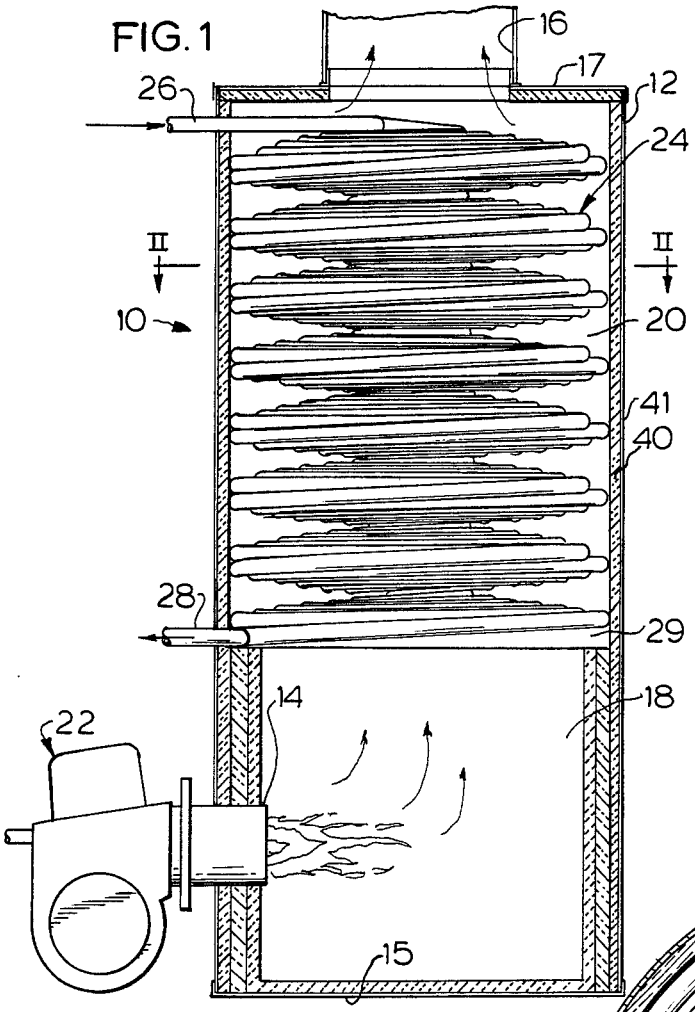
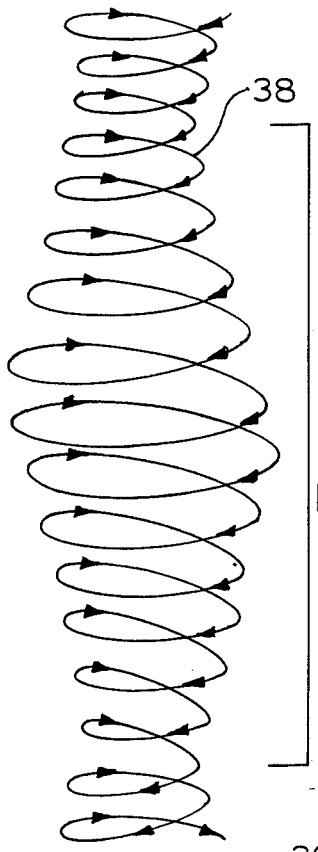
FIG. 4
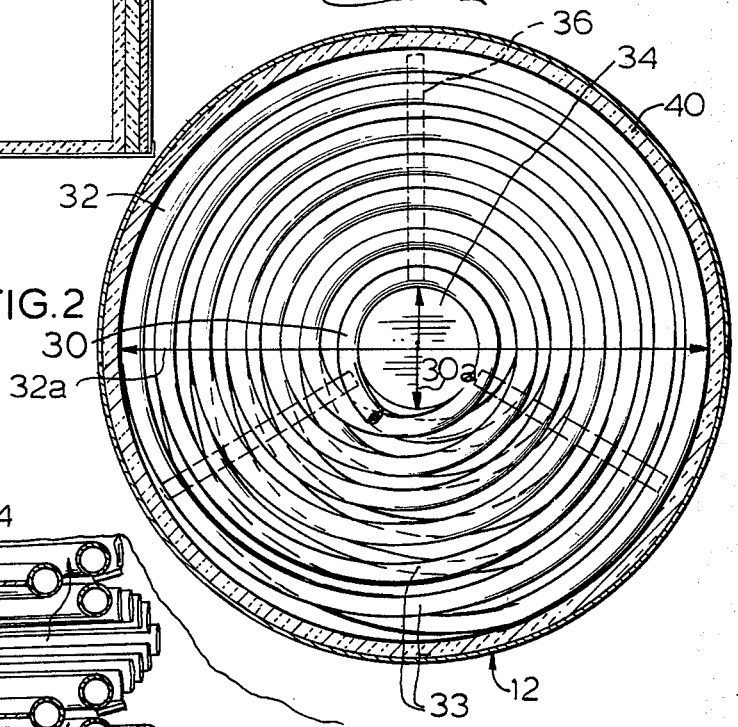
FIG. 2
FIG. 3
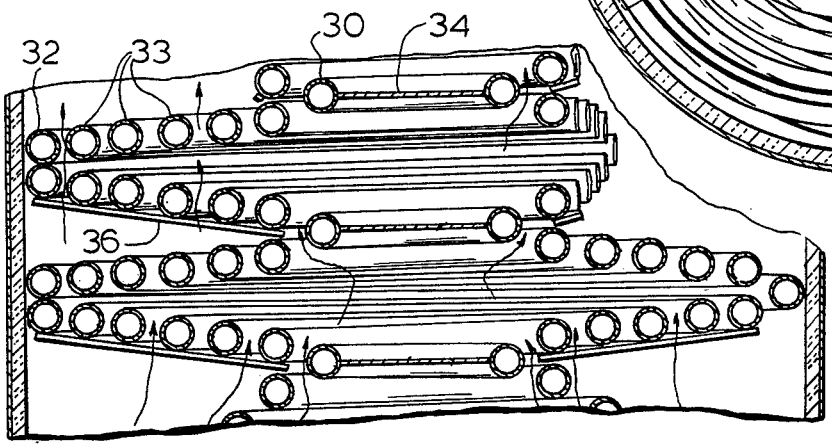

HEAT EXCHANGER AND METHOD OF MAKING SAME

BACKGROUND OF THE INVENTION

1. Field of the Invention

The present invention relates to heat exchangers and more particularly to helical wound tubing heat exchangers and methods of making such exchangers.

2. Description of the Prior Art

Heat exchangers known and used for transferring heat energy from one medium to another sometimes consist of an array of tubes positioned within a housing. A medium to be heated and a medium giving up the heat are on opposite sides of the flow restricting paths. Oftentimes the flow through the tubes is split such that the tubes form a plurality of independent paths through the interior of the heat exchanging unit with each tube making one or more passes through the heat exchanging zone. Many of these prior heat exchangers are relatively inefficient in transferring heat energy from one medium to another because of an insufficient amount of surface area presented to the heated medium or else require an extraordinary amount of space in order to achieve efficient levels of heat transfer.

SUMMARY OF THE INVENTION

The present invention provides for a compact heat exchanger in which the medium to be heated passes through the heat exchanging zone through a continuous tube which provides a large surface area in a compact format. To achieve this, the single tube is wound in an alternating series of conical helical winds forming a coil having a maximum outside diameter and a minimum inside diameter. A plurality of alternating series of conical helical winds are provided to increase the heat transfer.

The medium to be heated flows through the coil at a continuous downward slant of approximately 0.5° to the outlet at the bottom of the coil. This makes the coil self draining when a liquid is used as the medium to be heated.

The coil may be made from a plurality of equal length pipes welded together or from a single length of pipe. If the heat exchanger is made of a plurality of equal length pipes, the method of manufacture would include using a single mandrel to form the conical helical winds and then welding the conical coils together in alternating fashion. If the heat exchanger is made of a continuous length of tubing, all conical helical winds are made on one machine without the need for any welding. To perform this method of manufacture, a plurality of mandrels are required.

BRIEF DESCRIPTION OF THE DRAWINGS

FIG. 1 is a side sectional view of a heat exchanger showing the coils in full view.

FIG. 2 is a cross sectional view of a heat exchanger taken generally along the lines II—II of FIG. 1.

FIG. 3 is an enlarged partial sectional view through the coils.

FIG. 4 is a schematic view of the flow path of the medium to be heated through the coil.

DESCRIPTION OF THE PREFERRED EMBODIMENTS

Figure 5:
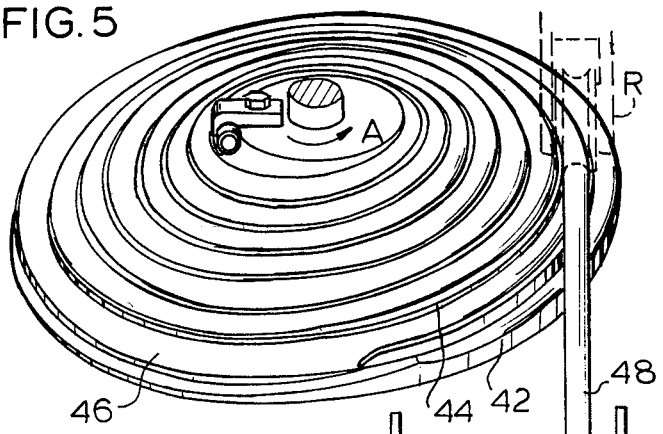
FIG. 5 is a schematic view of one method of constructing the coil utilized in the present invention.

In FIG. 1 there is shown a heat exchanger generally at 10 which is comprised of a generally cylindrical housing 12 having a vertically disposed axis with an inlet opening 14 near a bottom end 15 and an outlet opening 16 at a top end 17. The housing 12 has a generally open chamber 18 at the bottom end 15 communicating with the inlet opening 14 and being disposed below a heat exchanging chamber 20 positioned directly below the outlet opening 16. A source of heated fluid being the medium from which heat energy is to be transferred is shown generally at 22, which in the embodiment shown in FIG. 1 comprises a burner and fan device which directs fuel and air for combustion into the chamber 18 interior of the housing 12 through the inlet opening 14. Heated mediums, other than combustion products, which are capable of flowing can be utilized in the present invention. This includes generally any type of fluid, either liquid or gas which can flow from the inlet opening 14 through the interior of the housing 10 and out through the outlet opening 16.

A coil arrangement is shown generally at 24 which is comprised of a plurality of alternating conical helical winds of tubing having an inlet end 26 positioned near the top end 17 of the heat exchanging chamber 20 and an outlet end 28 positioned near the bottom end 29 of the heat exchanging chamber 20.

As seen in greater detail in FIGS. 2 and 3, the coil 24 comprises an alternating series of windings having an innermost winding 30 forming an interior diameter **30*a* of the coil and an outer winding 32 forming an outer diameter 32*a* of the coil. Intermediate windings 33 are formed between the interior winding 30 and the exterior winding 32. Secured, for instance by welding, to the interior diameter of the interior coil 30 is a baffle plate 34 which prevents the heated medium from flowing primarily up through the relatively large space within the interior diameter 30*a* of the inner coil 30. The heated medium is thus forced to flow between the individual windings 33, which are maintained in spaced relationship, presenting a plurality of flow paths. The tubing is arranged in a series of alternating helical winds which have reversing conical shapes such that there is a continuous and constant downward slope or slant from the inlet end 26 of the tubing to the outlet end 28**. It has been found that a slant of approximately 0.5° is sufficient to allow a liquid type fluid having a viscosity approximately that of water to flow downwardly through the tubing so that the coil is self draining while also allowing for a compact format for the coil. Auxiliary pumps may be used to pump the liquid through the coil depending on coil size, slant and liquid flow rate desired. The slant of the coil can be more or less than the 0.5° specified, as required.

The downward slope or slant of the coil is maintained by using a plurality of reinforcing members 36 such as elongated bars which are attached, for instance by welding, to the underside of each of conical winds. The reinforcing means not only maintain the tubing at the appropriate slant angle, but also maintain an optimum spacing between adjacent winds enhancing uniform flow of the heated medium through the heat exchanging zone 20 around each of the individual winds.

As seen in FIG. 2, the outside diameter 32*a* of the outer winding 32 is slightly smaller than the inside diameter of the cylindrical wall 12 of the housing such that virtually the entire lateral cross section within the heat transfer zone is provided with tubing thereby maximizing the surface area of the tubing within the heat transfer zone 20. The baffle plates 34 are welded to the inner diameter 30*a* of the inner winding 30 to prevent the heated medium from flowing up through the inner diameter space. Because the windings are constructed in a continuous and downward slant, the baffle plates 34 cannot be welded in a continuous manner around the entire interior diameter 3*a*, but rather are attached along a portion of their circumference. Thus, some heated medium does flow up through the inner diameter 30*a*, but most of it flows up around the intermediate windings 33.

The medium to be heated is introduced into the coil 24 through the inlet end 26 near the top of the heat transfer zone 20 where it is relatively cool and it flows downwardly through the coil in alternating inward and outward spiral fashion as is shown by the schematic view in FIG. 4 at 38 to where it exits from the heat transfer chamber 20 through the outlet end 28 having attained a relatively high temperature. The heated medium is introduced through the chamber 18 at a relatively high temperature and then flows upwardly through the heat transfer chamber 20 to the exit opening 16 at the top of the chamber. Thus, there is provided a counter flow heat exchanger which further enhances the efficiency of the heat transfer. The number of series of alternating conical helical winds can be selected based upon the amount of heat transfer desired and space availability.

The heat transfer housing 12 is provided with an insulating layer 40 around the entire periphery which is increased in thickness in the inlet chamber 18 due to the high temperatures there. The insulation retains heat energy within the interior of the housing 12 and permits an outer wall 41 of the housing to remain relatively cool.

Figure 6:
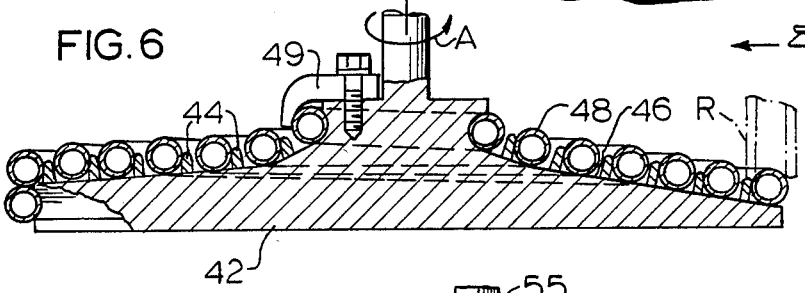
FIG. 6 is a side sectional view of the mandrel and tubing arrangement using the method shown in FIG. 5.

The heat exchanger coil which is disclosed above can be manufactured by at least two methods. A first method of manufacturing, shown in FIGS. 5 and 6, is relatively simple from a tooling aspect, but it does require considerable labor. In this method, numerous conical helical winds are made from identical lengths of tubing pipe, using one mandrel 42 (FIGS. 5 and 6) to form the winds. The mandrel 42 is shaped as a cone with ribs or channels 44 formed on an exterior surface 46 to hold and guide the tubing 48 as it is wound around the mandrel. Preferably the mandrel 42 is rotated as shown by arrow A and the tubing 48 is biased against the mandrel by a roller means R shown in phantom. The tubing used, for instance A53 pipe, is flexible enough to be wound on the mandrel 42, yet rigid enough to retain its shape once wound. A clamp 49 secures a first end of the tubing 48 during the winding process. The tubing 48 can be carried on a roll 50 from which it is drawn by rotation of the mandrel 42. The mandrel can be rotated manually or automatically for instance by a driving means 51 such as a motor.

Figure 8:
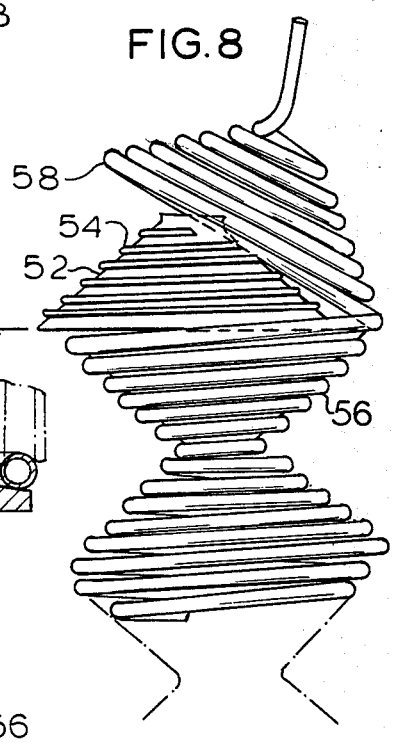
FIG. 8 is a partial side elevational view showing the tubing displaced for removal of the mandrel in the second method shown in FIG. 7.
Figure 7:
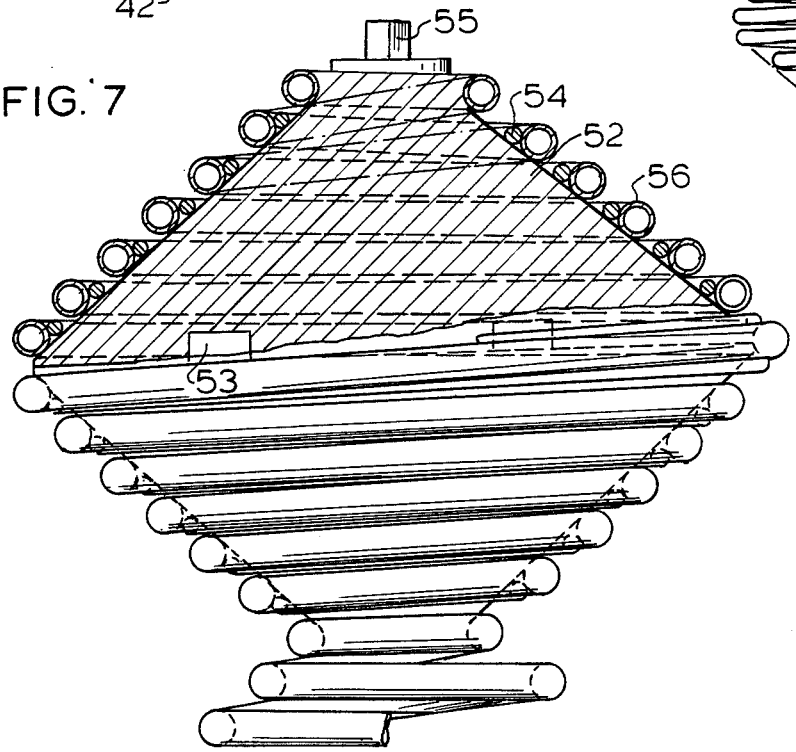
FIG. 7 is a partial side elevational view partially in section of a mandrel and tubing arrangement used in a second method of constructing the coil utilized in the present invention.

A second method of manufacture requires more complex tooling. All of the conical helical winds are made on one machine from one continuous length of tubing. With this method, there is not a requirement for any welding of the individual winds. However, by this method, numerous mandrels are required. The mandrels 52 (FIGS. 7 and 8) are cone shaped and have ribs or channels 54 formed on an outer surface with a slope in excess of the slope desired for the conical winds, for instance a 5° slope instead of a 0.5° slope for the winds.

The mandrels 52 are arranged in front-to-front and back-to-back assembly on a square shaft 55 to present the conical and reverse conical shape. A continuous length of tubing 56 is then wound or wrapped around the assembly of mandrels 52 in a manner similar to that described above. The conical angle or slope of the tubing is exagerated as described above to allow for removal of the mandrels. The mandrels 52 are retained in appropriate rotational registry with each other by locating means 53 to ensure that the continuous length of tubing 56 will have the necessary slope throughout its length, particularly where the two mandrels are joined. After the winds have been formed in the tubing, the shaft 55 is removed and adjacent winds are separated longitudinally at each wide diameter as at 58 in FIG. 8 so that the mandrels 52 may be laterally removed one at a time from the interior of the tubing. The entire coil is then compressed axially until the desired final slope is attained and then the retaining means 36 are secured to the winds which retain the coil in the desired shape. The coil is then placed within the heat exchanging chamber 20 and the inlet end 26 and outlet end 28 are inserted through appropriate openings in the housing 12.

Therefore, it is seen that there is provided a heat exchanging device in which heat energy is transferred from a first heated medium to a second medium to be heated within a heat transfer zone which can be compact and in which there is a conduit carrying the medium to be heated which exhibits a large surface area relative to the volume of the heat exchanging zone so as to maximize the transferring of heat energy.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A heat exchanging device comprising:

a generally cylindrical housing disposed vertically with an inlet at a bottom end and an outlet at a top end;

a source of heated medium in communication with said housing inlet to introduce said heated medium into said housing;

a coil for carrying a liquid to be heated fabricated of a heat transfering material having at least one series of alternating conical helical winds positioned within said housing between said housing outlet and a coil outlet extending through said housing near said housing inlet and said housing outlet and having a coil inlet extending through said housing near said housing inlet;

said heated medium flowing upwardly through said housing from said housing inlet to said housing outlet over said coil;

said liquid to be heated flowing downwardly through said coil;

said coil having a continuous downward slope throughout its length of sufficient grade to permit said liquid to be urged toward said coil outlet by gravity;

a substantially horizontal baffle plate secured to an inner diameter of said conical helical winds to cause the heated medium to flow past said winds of said coil; and means including reinforcing members extending radially outward and upward secured to the underside of said winds to maintain said winds at said continuous downward slope and at a desired lateral spacing; whereby heat energy in said heated medium is transfered to said medium to be heated during a counter flow of said two mediums in said housing.

2. A device of claim 1, wherein said coil has an outer diameter slightly smaller than an inner diameter of said housing.

3. A device of claim 1, wherein said coil fills nearly the entire lateral cross section of the interior of said housing.

4. A device of claim 1, wherein said housing is insulated to retain heat energy within the interior of said housing and to keep an outer wall of said housing relatively cool.

5. A device of claim 1, wherein said slope is approximately 0.5°.

* * * * *